US006050910A

United States Patent [19]

Holman et al.

[11] Patent Number: 6,050,910

[45] Date of Patent: Apr. 18, 2000

[54] MAPLE BASEBALL BAT CONSTRUCTION

[76] Inventors: Sam J. Holman, 93 Bayswater Ave., Ottawa, Ontario, Canada, K1Y 2G2; Daniel S. Boland, 169 MacMillan Lane, Constance Bay, Canada, K0A 3M0

[21] Appl. No.: 09/073,473

[22] Filed: May 6, 1998

Related U.S. Application Data

[63] Continuation-in-part of application No. 08/789,041, Jan. 28, 1997, abandoned.

[51] Int. Cl.[7] ..... A63B 59/06

[52] U.S. Cl. ..... 473/564

[58] Field of Search ..... 473/564–568, 473/457

[56] References Cited

U.S. PATENT DOCUMENTS

| | | | |
|---|---|---|---|
| 514,420 | 2/1894 | Jacobus | 473/564 |
| 1,121,189 | 12/1914 | Lincoln | 473/564 |
| 2,944,820 | 7/1960 | Paullus . | |
| 3,433,481 | 3/1969 | Tanguay . | |
| 5,088,733 | 2/1992 | Barnea et al. . | |
| 5,165,686 | 11/1992 | Morgan . | |
| 5,620,179 | 4/1997 | MacKay, Jr. . | |

FOREIGN PATENT DOCUMENTS

| | | | |
|---|---|---|---|
| 22649 | 7/1948 | Finland | 473/FOR 169 |
| 23495 | 9/1949 | Finland | 473/FOR 169 |

OTHER PUBLICATIONS

Sports Illustrated, p. 16, Aug. 1980.

Article from the Sporting Goods Dealer/Oct. 1977—Cupped Balanced Softball Bat.

*Primary Examiner*—Mark S. Graham
*Attorney, Agent, or Firm*—Gifford, Krass, Groh, Sprinkle, Anderson & Citkowski, P.C.

[57] ABSTRACT

A baseball bat turned from a single piece of maple wood and including an elongate and substantially circular cross sectional shaped body with a handle portion terminating at a first end in an integral knob, an outwardly tapered and intermediate portion extending from the handle portion, and a barrel portion defining a ball hitting portion and extending from the intermediate portion so as to terminate at a second end. The second end of the barrel portion establishes in cross section a substantially cylindrical shaped and recessed cavity, the cavity being defined by an annular inner wall and a substantially flat end wall. A cross sectional end face of the integral knob further being defined by a concave surface which establishes a further recess cavity. The maple construction further provides a bat which is equivalent in weight to ash while narrower in barrel diameter, longer in effective hitting length and, as a result of its narrower diameter, is faster in swinging velocity.

3 Claims, 2 Drawing Sheets

MAPLE BASEBALL BAT CONSTRUCTION

CROSS REFERENCE TO RELATED APPLICATIONS

The present application is a continuation-in-part of U.S. Ser. No. 08/789,041, filed Jan. 28, 1997, now abandoned, for wooden baseball bat and method.

BACKGROUND OF THE INVENTION

1. Field of the Invention

The present invention relates generally to the technology surrounding the design and manufacture of wooden baseball bats such as ash bats and, more particularly, to an improved baseball bat construction which takes advantage of a solid maple composition and which is particularly suited for professional level game play.

2. Description of the Prior Art

Baseball bats, particularly those constructed of wood, are well known in the art. The most well known of wooden bats is the traditional ash bat which exhibits a fairly straight wooden grain surface and is found to be consistently in the range of 60 percent specific gravity. Such bats are very well known in the art, however their drawback is that they are very prone to chipping, denting or outright breaking during game play. Also, even if the traditional ash bat survives catastrophic failure upon contacting a pitched ball, the hitting surface of the barrel will quickly erode due to the repeated contact with the ball. Baseball players, particularly professionals, have adopted the practice of taping the barrel of ash bats in batting practice to prolong their usefulness by reducing the aforementioned surface deterioration, this being an undesirable necessity in prolonging the life of ash bats.

As a result of this weakness, the typical professional hitter will go through an average of 73 ash bats during a typical major league baseball season of 162 games. Further, the lower grades of wood, such as ash, which are utilized in such bats are generally not as resilient as in higher grades of wood, resulting in a ball not traveling as far once it has been hit with a specified degree of force and speed. U.S. Pat. No. 3,433,481, issued to Tanguay et al., is directed to reinforced baseball bat wrappings and indicates, at column 1, lines 35–45, that wrappings have been attempted in the art for such things as maple and mahogany bat designs. However, Tanguay further states that such maple or mahogany bat designs, up to that point in time, would not be economically practicable due to their incidence of breakage and it is further known that reinforcing baseball bat wrappings and the like are not permitted for use in professional and instructional hitting game play. It is was also well known in the earlier art that such bat compositions as mahogany and maple were at that time unsuitable owing to the denser natures of such woods and the relatively primitive nature of earlier processes of manufacture which could not overcome such problems as weight, brittleness and curly grainings which made manufacture of such bats for the purpose of game play and instructional hitting nearly impossible. Die cast aluminum and magnesium alloy bats are also known in the art, however such metal bats are not authorized for professional league play. Accordingly there is still a need in the art for a durable wooden bat construction with performance characteristics superior to that of ash such as durability and longevity.

SUMMARY OF THE PRESENT INVENTION

The present invention is a baseball bat turned from a solid piece of maple wood and including a handle portion terminating at a first end in an integral knob. An outwardly tapered and intermediate portion extends from the handle portion and in turn is integrally formed with a ball hitting barrel portion, the barrel portion terminating at a second end. Modifications to the taper and barrel of the maple bat further result in a narrower barrel and taper as opposed to an ash bat, while retaining the same overall weight, and thusly improve the bat speed and effectiveness of the maple bat construction.

The second end of the barrel portion establishes in cross section a substantially cylindrical shaped and recessed cavity which is defined by an annular inner wall and a substantially flat end wall. An annular boundary separates the annular inner wall and the substantially flat end wall and is defined by a 45 degree radial curved portion. Due to the higher relative density and strength of maple, as opposed to ash, the more pronounced and substantially cylindrical configuration of the barrel end recess cavity is made possible and contributes to an overall weight reduction and increased balance of the maple bat, the balance causing a center of mass and center of gravity of the bat to move in a direction along the barrel and towards the batter. This results in the ability to utilize a greater length of the barrel section for efficient ball contact. The narrowing of the barrel enables the barrel to be correspondingly lengthened in a direction towards the intermediate taper and handle portion and further results in both a lengthened barrel hitting surface and quicker bat speed owing to its narrowed diameter.

An additional feature of the present invention resides in the cross sectional face of the integral knob which is defined by a concave surface establishing a second smaller recess cavity at the opposite and handle end of the bat. A yet further feature is in the dimensioning of the handle portion so that the minimal diameter is located forwardly of the location of the batter's bottom or back hand that grips the bat handle. This is so to reduce stinging of the batter's hands resulting from the contacting of the ball by the maple bat and differentiates from traditional ash bat constructions wherein the narrowest part of the bat is located close to the knob end of the handle. The maple bat construction of the present invention also results in doing away with the necessity of taping the barrel during batting practice, such as is common with ash bats, and in order to extend the useful life of the bats.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENT

Figure 1:
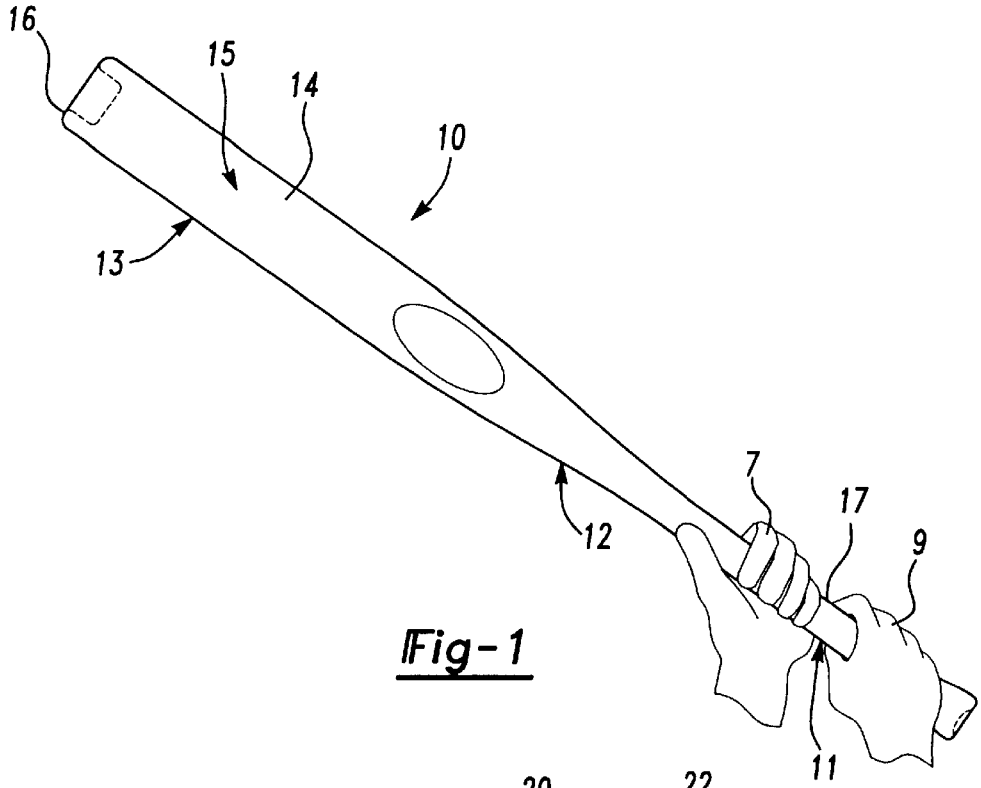
FIG. 1 is a lengthwise elevational view of the maple baseball bat construction of the present invention.

Referring now to FIG. 1, a baseball bat is illustrated at 10 according to the preferred embodiment of the present invention. As an initial point, the bat 10 differs from those conventionally used in professional and amateur game play in that it is constructed of a higher density and durable maple (approximately 63% to 65% specific gravity) as opposed to ash which is more on the order of 60% specific gravity. The inconsistent specific gravity and the curly grain require a specific learning curve on how to "read" the grain of maple so as to determine the suitability of a selected wood for carving. This, as described in the background description, contributed to the shortcoming of the maple bat constructions of the prior art in creating a suitable maple or mahogany bat construction. The composition of the bat 10 as being from maple accordingly further provides a superior surface resilience and its design modifications further result in an obvious reduction of weight and taper of the bat in the fashion subsequently described and claimed.

Specifically, the bat 10 includes a lower handle portion 11 which terminates in an integral knob 11' at a first end, an outwardly tapered and intermediate portion 12 which extends from the handle portion 11, and a barrel portion 13 having a front side 14 which defines a ball hitting portion 15 and which terminates at a second end 16. The lower handle portion 11, integral knob 11', outwardly tapered portion 12 and barrel portion 13 all are generally circular in cross section as is well known in the art.

The barrel portion 13 illustrates a larger diameter than the handle portion 11 as is standard in construction. However, when further considering the characteristics of closed grain hardwood such as maple, which has the higher specific gravities, again in the 63% to 66% range, as compared to white ash it is possible to obtain a barrel portion 13 which is slimmer in diameter for the same weight and taper. The ability to provide a narrower (lesser diameter) barrel portion 13, combined with the ability to lengthen the barrel portion 13 relative to the intermediate tapered portion 12, creates a bat which may be swung with more velocity and which also includes a more elongated barrel relative to a conventional ash bat, thus creating an increased "hitting zone".

An example of a conventional ash bat 34 inches in length and weighing 31.6 ounces includes a barrel end diameter of 2 5/8 inches, a hitting (barrel length) of 10 inches and a dimension at the start of the bat taper at 2 3/8 inches. An approximate example of a maple bat construction according to the preferred embodiment of the present invention weighs 31.9 ounces and includes a barrel end diameter of 2 2/8 inches, a hitting length of the barrel at 11 inches and a dimension of bat at start of taper at 2 inches. The resulting difference is that the maple bat construction of the present invention provides a barrel portion which is narrower than that of the ash bat of equal length and similar weight and thus may be swung with increased velocity. This being accomplished while still lengthening the prime hitting surface of the barrel portion by an inch (from 10" to 11").

A further example of a conventional ash bat (one with a minimal conical recess as illustrated with reference to FIG. 4 of the present disclosure) is 34 inches in length, weighs 31.5 ounces and includes a barrel end dimension (diameter) of 2 4/8 inches, a dimension (diameter) six inches from the barrel end of 2 3/16 inches and a further such dimension twelve inches from the barrel end of 1 7/8 inches. In comparison, a corresponding maple bat construction according to the present invention which is also 34 inches in length weighs 32.6 ounces and includes a barrel end dimension of 2 1/8 inches, a dimension at six inches from the barrel end of 2 2/86 inches and a dimension at twelve inches from the barrel end of 1 13/16 inches. The differences again in this example are that the maple barrel on average is 2/16 inches narrower than the equivalent ash bat, however weighs only one ounce more on a minimally (1/8") cupped end. When comparing the dimensioning of the maple bat construction according to the present invention to that of standard and prior art ash constructions, it is clearly evident that reduction of weight from the barrel and taper are not taught in the prior art where the maximum allowed barrel dimension is expected and preferred.

Referring again to FIG. 1, a further distinguishing feature of the maple bat construction 10 of the present invention is that a minimal diameter 17 of the handle portion 11 is positioned forwardly of the location in which the bottom or back hand of the player grips the handle (see top hand 7 and bottom hand 9 in FIG. 1 an in relation to minimal diameter location 17) and is contrary to the teachings of standard ash bats. The purpose again for the location of minimal diameter 17 is to reduce vibrations resulting from contact of the maple bat with the ball, this being a phenomena not occurring with standard ash bats.

Figure 2:
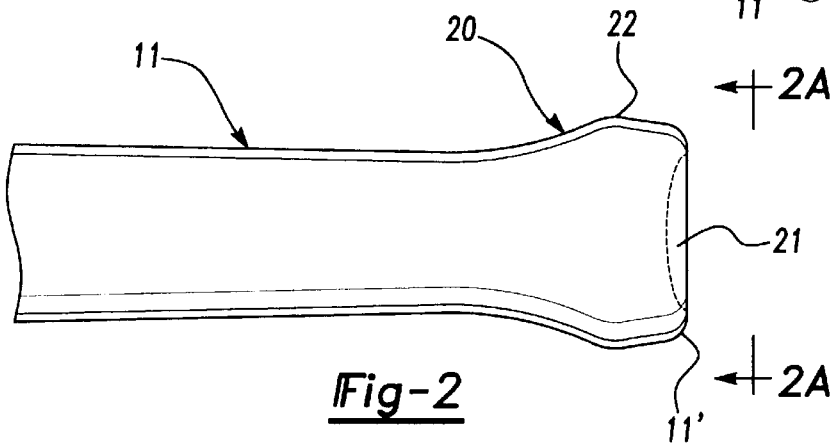
FIG. 2 is a first sectional view of the handle portion and integrally formed knob according to the bat construction of the present invention.
Figure 2A:
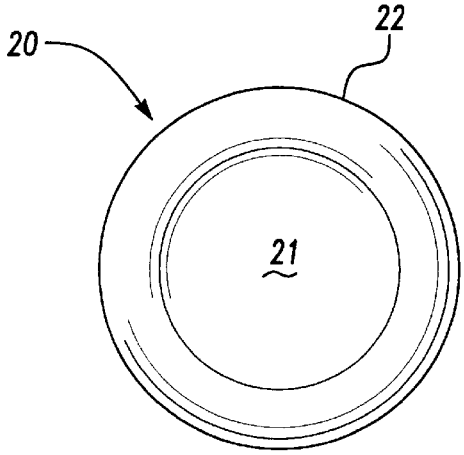
FIG. 2*a* is an end view of the integral knob and handle portion illustrated in FIG. 2.

Referring to FIG. 2, a sectional view is illustrated of the handle portion 11 and integrally formed knob 20 according to the present invention which defines a concave surface 21 across is cross sectional face. Referring also to the end view of FIG. 2*a*, the integral knob 20 includes an outwardly projecting annular portion 22, the purpose of which is to further reduce the weight of the bat.

In a preferred application, the wetting of the handle portion 11 of the bat 10 will result in the grain of the maple rising an incremental degree and to thereby provide a natural sand paper grip when swinging it in an attempt to hit an oncoming ball. As is also known with maple, the natural graining produces two "ribbons" on every bat, which ribbons represent a selected grain orientation of the bat. Ideally, one of the ribbons extending along the barrel portion 13 makes contact with the pitched ball for optimum power and minimizing of incidence of bat breakage.

Figure 3:
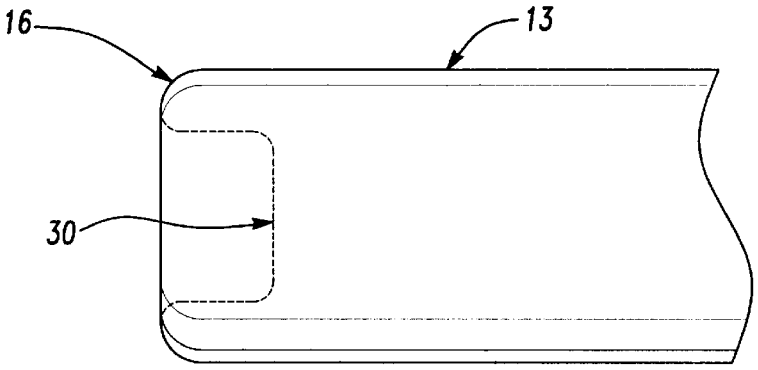
FIG. 3 is a second sectional view of the barrel end portion according to the bat construction of the present invention.

Referring further to FIG. 3, the barrel portion 13 of the bat is again showed and further illustrated in phantom is a substantially cylindrical shaped and recessed cavity 30 formed in the cross sectional end face of the barrel portion 13. Referring further to FIGS. 4 and 5, sectional and end views are illustrated, respectively, of the end of the barrel portion 13 with uniquely configured recess cavity according to the present invention.

Figure 4:
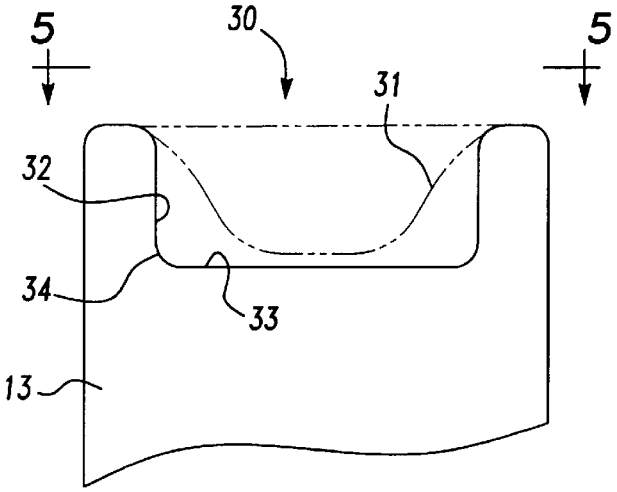
FIG. 4 is a further sectional view similar to that illustrated in FIG. 3 and enlarged to show the substantially cylindrical shaped and recessed barrel end cavity of the maple bat construction according to the present invention.
Figure 5:
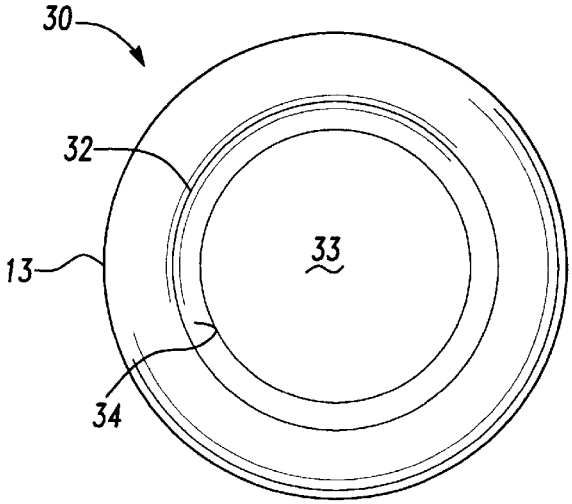
FIG. 5 is an end view of the recessed barrel cavity shown in FIG. 4 and according to the preferred embodiment of the present invention.

As is specifically shown in FIG. 4, phantom line 31 illustrates the extent of recessing, or cupping, to which conventional ash bats may be machined to optimize their weighting and resiliency. Reference is also made to the Hillerich & Bradsby bat disclosure which teaches this "cupping" of the barrel end face.

In contrast to the prior art teachings, the recessed cavity 30 of the present invention includes an annular inner wall 32 which connects to an inwardly recessed bottom or end wall 33 in order to create the substantially cylindrical shaped recess. An annular boundary 34 is established between the annular inner wall 32 and end wall 33 and is accomplished by machining a 45 degree radial curve. The ability to machine the appropriate cylindrical recessed cavity in the end of the barrel section 13 utilizes technology known in the art, however it is the ability to machine the recessed cavity 30 of the present invention that is a non-obvious improvement over the lesser cup-shaped cavities (illustrated again by the phantom line 31). The increased cavitation 30 of the barrel end of the maple bat of the present invention is made possible by the higher specific gravity and strength of the maple wood as opposed to ash and lends enhanced weight reduction/control and resiliency to the bat. It is further established that the unique configuration of the barrel recessed cavity 30 of the present invention is not illustrated anywhere in the prior art.

It is therefore apparent that the present invention discloses a maple bat construction of unique character and performance which is a vast improvement over prior art ash bats and the like. Having described my invention, additional embodiments will become apparent to those skilled in the art to which it pertains without deviating from the scope of the appended claims.

I claim:

1. A baseball bat turned from a single piece of maple wood, said bat comprising:

an elongate and substantially circular cross sectional shaped body including a handle portion which terminates at a first end in an integral knob, an outwardly tapered and intermediate portion extending from said handle portion, and a barrel portion defining a ball hitting portion and extending from said intermediate portion so as to terminate at a second end; and said second end of said barrel portion establishing in cross section a substantially cylindrical shaped and recessed cavity, said cavity being defined by an annular inner wall and a substantially flat end wall, an annular boundary being established between said annular inner wall and said flat end wall, said annular boundary being formed as a 45 degree radial curve;

the composition of the maple wood exhibiting a sufficient density such that said recessed cavity is capable of maintaining its integrity during use of the bat and without any form of internal support positioned within said recessed cavity, said cavity also provides both weight reduction and increased balance of said bat.

2. The baseball bat according to claim 1, further comprising a cross sectional end face of said integral knob being defined by a concave surface which establishes a further recess cavity.

3. The baseball bat according to claim 1, said handle portion further comprising a minimal diameter located forwardly of a location of a player's back hand positioned on said handle portion and on a side opposite said integral knob.

* * * * *